US006422393B1

(12) United States Patent
Van Jahnke

(10) Patent No.: US 6,422,393 B1
(45) Date of Patent: Jul. 23, 2002

(54) RECOVERY FROM FINE FROTH FLOTATION FEED (SLIMES)

(76) Inventor: Jeffrey Van Jahnke, 2 Meadow Lark Rd., Asheville, NC (US) 28805

( * ) Notice: Subject to any disclaimer, the term of this patent is extended or adjusted under 35 U.S.C. 154(b) by 0 days.

(21) Appl. No.: 09/549,461

(22) Filed: Apr. 14, 2000

(51) Int. Cl.[7] ..... B03D 1/02; B02C 23/10

(52) U.S. Cl. ..... 209/164; 209/3; 241/21; 241/24.1

(58) Field of Search ..... 209/166, 167, 209/3, 164; 241/21, 24.1

(56) References Cited

U.S. PATENT DOCUMENTS 1,448,514 A * 3/1923 Borcherdt
1,448,515 A * 3/1923 Borcherdt
1,585,756 A * 5/1926 Borcherdt
1,619,790 A * 3/1927 Bragg
2,569,672 A * 10/1951 Jackson
2,791,382 A * 5/1957 Myers
2,990,958 A * 7/1961 Greene
3,151,062 A * 9/1964 Duke
3,417,927 A * 12/1968 Crocker
3,805,951 A 4/1974 Brogoitti et al.
3,942,727 A * 3/1976 Fahlström et al.
4,192,737 A * 3/1980 Thompson et al.
4,440,636 A * 4/1984 Lilley
4,726,896 A 2/1988 Grove et al.
4,737,273 A 4/1988 Snow
4,867,867 A 9/1989 Lilley
4,960,509 A 10/1990 McNeill
4,997,550 A 3/1991 Cobb et al.
5,035,365 A 7/1991 Birmingham
5,316,223 A 5/1994 Lahoda et al.

* cited by examiner

*Primary Examiner*—Thomas M. Lithgow
(74) *Attorney, Agent, or Firm*—Carter & Schnedler, P.A.

(57) ABSTRACT

A process for the recovery of minerals from the fine particle size fraction of froth flotation feed (slimes), which is conventionally discarded to waste because slimes interfere with efficient flotation. In the disclosed process, the slimes, which also may be termed fines, are scrubbed to clean the slimes, and are then subjected to conventional froth flotation. The scrubbing is done in the presence of an attrition media, in addition to chemical reagents for cleaning and dispersing fine particles. Thus an inert attrition media, of larger particle size than the slimes, is introduced into a scrubber. The process accordingly recovers a fine fraction of the flotation feed that is normally lost. The recovery process may be incorporated into an existing plant design, or as part of a new plant designed to recover material previously discarded in waste disposal areas.

12 Claims, 3 Drawing Sheets

RECOVERY FROM FINE FROTH FLOTATION FEED (SLIMES)

BACKGROUND OF THE INVENTION

The invention relates generally to froth flotation for separating out minerals from ground-up ore and, more particularly, to the recovery of minerals from the relatively fine particle froth flotation feed, commonly known as "slimes," which conventionally is discarded.

Froth flotation is a well-known process used to separate minerals, ground up into particles and suspended in or otherwise carried by a liquid, by attaching the mineral particles to gas bubbles to provide selective levitation of the solid particles into a froth. Conventionally the liquid is water. Selective levitation is accomplished by conditioning a flotation feed in the form of a slurry with various flotation reagents that selectively coat the particle surfaces of various minerals. The surface coating allows for either air bubble attachment to individual particles or prevents air bubble attachment, depending on the specific reagents used in conditioning and subsequent flotation. In some cases the desired mineral particles are carried upward into the froth and collected as product, leaving other material to settle as tails, which can be waste. In other cases, undesired particles are carried upward into the froth and discarded as waste, leaving desired mineral particles to settle as tails, which is collected as product.

For effective separation, it is essential that the particles be discrete particles of the individual minerals. To promote the most efficient and selective response to the flotation reagents utilized, it is also important that the particles have clean non-contaminated surfaces. (However, not all froth flotation facilities employ scrubbers.)

To produce discrete mineral particles, ore is crushed and ground to nominally 1 mm diameter and finer particle size for flotation feed. This crushing and grinding produce some material as fine as 0.001 mm. Normal flotation practices are performed over a particle size range of the feed determined to yield the most efficient, cost-effective and quality-acceptable flotation product. The following table lists the desired smallest size particle for flotation feed for various minerals, which may be viewed as a minimum particle size cut off point, as given by Crozier in *Flotation, Theory, Reagents and Ore Testing.*

TABLE

| Mineral | Minimum Particle Size |
|---|---|
| feldspar | 0.074 mm |
| phosphates | 0.105 mm |
| potash | 0.074 mm |

These minerals are listed as examples only, and the list above is not all-inclusive. The majority of minerals recovered by froth flotation are currently processed at a minimum particle size cut-off point.

Relatively fine particles smaller than the minimum particle size, referred to as fines or slimes, interfere with efficient froth flotation. Under current practice slimes are therefore discarded, even though they contain significant quantities of usable minerals. For the minerals listed above, approximately 10%–20% of the flotation feed typically is finer than the minimum particle size cut-off point.

To provide mineral particles that have clean non-contaminated surfaces, scrubbing processes are employed in some froth flotation facilities. As an example, a conventional attrition scrubber takes the form of a tub into which a slurry is loaded. The slurry typically contains approximately 70% solids by weight in the form of particles to be cleaned, and is conditioned with cleaning reagents such as NaOH, $H_2SO_4$, sodium silicate, HCl and sodium hexametaphosphate, depending upon the particular minerals involved. Reagents serve cleaning, dispersion and conditioning functions. A rotating vertical shaft extends into the tub, and carries impellers which are angled so as to alternately push the slurry up and down. The particles rub against each other to effect cleaning, aided by the cleaning reagents.

SUMMARY OF THE INVENTION

It is therefore seen to be desirable to efficiently recover minerals from conventionally discarded fine froth flotation feed (slimes).

In an exemplary embodiment, the slimes are scrubbed in the presence of attrition media, and subsequently processed by froth flotation. The attrition media is removed either before or after froth flotation of the slimes.

DETAILED DESCRIPTION

The invention is based in part on a recognition that the relatively fine particles (slimes) interfere with efficient froth flotation because conventional scrubbing procedures do not produce the clean uncontaminated surfaces necessary for efficient flotation on the slimes particles. Clean surfaces and unagglomerated particles are essential for the selectivity of the flotation reagents. Embodiments of the invention employ scrubbing processes which clean the surfaces of the slimes particles, producing a flotation feed that reacts selectively and efficiently to subsequent flotation procedures.

Figure 1:
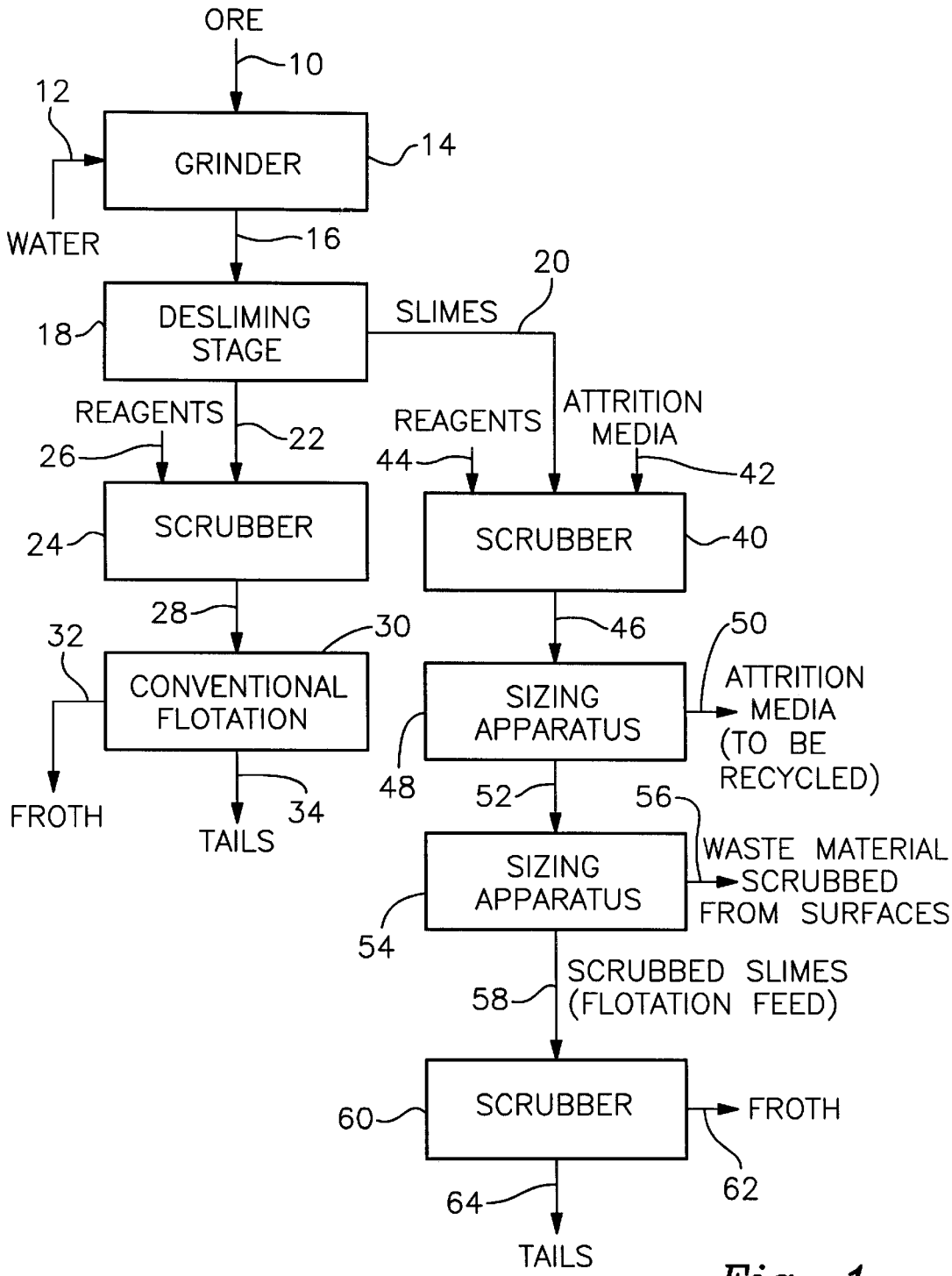
FIG. 1 is a schematic flow diagram representing an embodiment of the invention.

With reference to FIG. 1, represented in schematic flow diagram form is a process embodying the invention, carried out in a froth flotation facility for separating minerals from ground-up ore. As examples, the ore may be spodumene containing iron minerals, mica, spodumene, feldspar and silica; or may be feldspar ore containing iron minerals, mica, feldspar and silica. In FIG. 1, ore and water are introduced at 10 and 12 into a conventional grinder 14 which produces a slurry including discrete mineral particles. The ore is ground to a desired particle size ranging from 40 mesh, down to 200 mesh, nominally 0.42 mm and finer in diameter.

However, at the same time, finer particles are produced, smaller than 200-mesh, some particles as fine as 0.001 mm in diameter. These relatively finer particles are referred to as fines or "slimes," and interfere with the conventional forth flotation processes. For example, the slimes particles tend to non-selectively absorb froth flotation reagents, decreasing the overall efficiency of the process. In addition, slimes particles tend to stick to the desired mineral particles, resulting in contamination of the desired product.

Accordingly, a desliming stage 18 is conventionally employed, wherein slimes 20 are separated out from a stream 22 which becomes the froth flotation feed. Within the desliming stage 18, any one of or a combination of conventional sizing processes such as screening, hydrocycloning, hydrosizing, settling, as examples, are employed.

After desliming, the remaining feed 22 may be cleaned in a scrubber 24 in the presence of appropriate reagents introduced at 26, and is then delivered, as indicated by arrow 28, as flotation feed to a conventional froth flotation process 30, which includes conditioning with appropriate flotation reagents. Within the froth flotation process 30, separation occurs into froth 32 and material 34 which settles, known as tails. The froth flotation process 30, although shown as a single stage, may involve a number of successive flotations, as is well known. Thus, in the case of feldspar ore or spodumene ore, in a final flotation step, feldspar particles are floated as part of the froth 32, while silica particles settle as tails 34, both of which are recovered as products.

In conventional froth flotation facilities, the slimes 20 are discarded as waste, even though the slimes 20 in general contain significant quantities of the same desired minerals.

In the embodiment of the invention represented in FIG. 1, the slimes 20 are scrubbed in order to clean the slimes. In general, cleaning means to physically break apart agglomerated particles, and to clean the surfaces of the relatively fine slimes particles of, for example, oxidation or iron salts.

More particularly, the slimes 20 are delivered to a scrubber 40 in which the slimes are scrubbed in the presence of an attrition media introduced as represented at 42, as well as in the presence of appropriate reagents for cleaning and dispersing fine particles.

The addition of the attrition media 42 facilitates effective scrubbing of fine particles (slimes). Requirements for the attrition media are that it be an inert material and of a particle size larger than the slimes being scrubbed. In this context, "inert" means that the attrition media does not react chemically with water or with reagents used during scrubbing and froth flotation. The attrition media is typically a sand having a particle size ranging from approximately 0.50 mm down to 0.177 mm (20-mesh sand) of any compatible mineral, usually silica, but may be any natural or synthetic grinding media of suitable size and mass to effect thorough cleansing of the surfaces of the slimes particles. The larger size facilitates efficient removal of the attrition media, which can be recycled. The attrition media gives the slimes mass, which aids in physically breaking apart agglomerated particles. The attrition media also cleans the surfaces of these fine particles.

A quantity of attrition media 42 is added so that attrition media 42 makes up approximately 40% to 70% by weight of the solids in the scrubber 40. The percent of solids in the scrubber 40 (slimes and attrition media combined) is adjusted to approximately 70% to 75%, with the remainder being water. Scrubbing reagents 44 are added appropriate to the minerals present in the slimes 20. Scrubbing reagents 44 can include, but are not limited to, NaOH, $H_2SO_4$, sodium silicate, HCl and sodium hexametaphosphate. Reagents serve cleaning, dispersion and conditioning functions. The time required for scrubbing is dependent on the makeup of the slimes, and can range from approximately one minute to approximately thirty minutes.

Following the scrubber 40, feed 46 is directed to a sizing apparatus 48 wherein attrition media 50 is removed by sizing. The attrition media 50 is the coarsest fraction. The sizing apparatus 48 for example may comprise screens, a hydrocyclone, or hydrosizing apparatus, as examples. Preferably the removed attrition media 50 is recycled as at least part of the attrition media introduced at 42 into the scrubber 40.

The feed then proceeds as indicated by arrow 52 to another sizing apparatus 54 wherein waste material 56 scrubbed from the surfaces of the slimes is removed, as the finest fraction, and is discarded as waste. The sizing apparatus 54 likewise may comprise screens, a hydrocyclone, or hyrdosizing apparatus, as examples.

Scrubbed slimes which remains, then serves as a flotation feed 58 which yields a selective and efficient float. Thus, the flotation feed 58 is delivered to a froth flotation stage 60. Within the froth flotation stage 60, the flotation feed 58 is conditioned with flotation reagents, and froth flotation is carried out in flotation cells to separate the mineral particles.

The froth flotation stage 60, although shown as a single stage, may involve a number of successive flotations. Thus, in the case of feldspar ore, in a first flotation step, mica particles are floated as part of the froth, and can be recovered as a product, with remaining material settling as tails. In a second flotation step, iron mineral particles are floated as part of the froth, and can be recovered as product, with remaining material settling as tails. In a final flotation step, feldspar particles are floated as part of the froth 62, and are recovered as product, while silica particles settle as tails 64, and also may be recovered as product. In the case of spodumene ore, a similar sequence of flotation steps may be employed, with the addition of a flotation step, prior to the final step, during which spodumene particles are floated as part of the froth.

Depending upon the reaction of the minerals being treated, and the plant or facility flow design, flotation of the scrubbed slimes flotation feed 58 may be accomplished concurrently with and in the same cells as the conventional flotation feed 28, or in a separate flotation circuit.

The following EXAMPLES show the results of slimes processing as described above with reference to FIG. 1, using silica sand as the attrition media, and NaOH and sodium silicate as scrubbing reagents.

EXAMPLES

| Slimes Processed | Mineral Recovered | % wt. of Slimes Recovered |
|---|---|---|
| 1. Spodumene ore | feldspar | 35%–40% |
| | silica | 15%–20% |
| 2. Feldspar ore | feldspar | 35–40% |
| | silica | 10–15% |

For the foregoing EXAMPLES, flotation was performed according to conventional flotation procedures. The percent recovery was comparable to that achieved with the deslimed ore in the conventional flotation stage 30.

Figure 2:
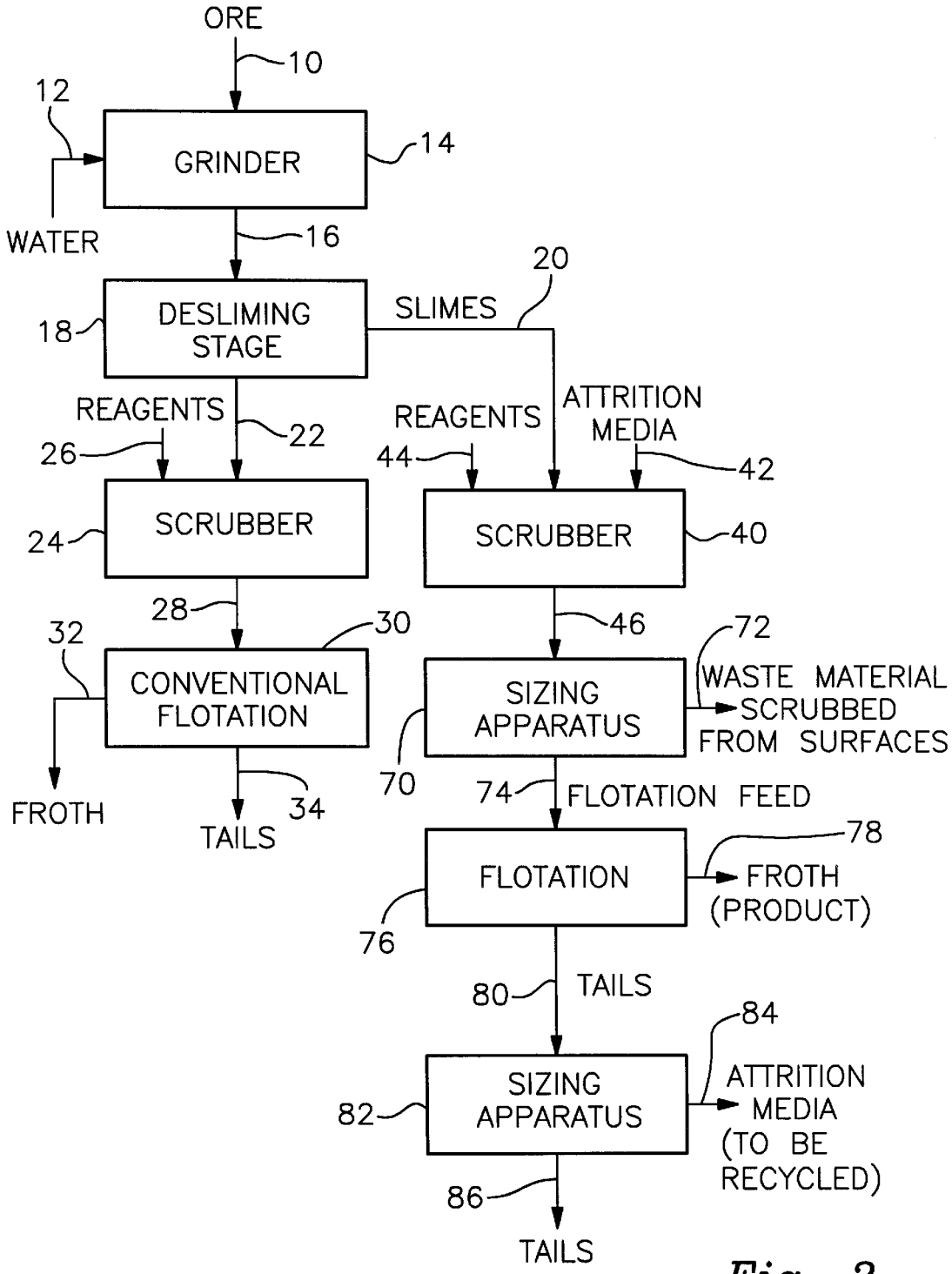
FIG. 2 is a schematic flow diagram representing another embodiment of the invention.

With reference now to FIG. 2, represented is another embodiment of the invention, differing from FIG. 1 only in the processing following the scrubber 40 wherein the slimes 20 are scrubbed in the presence of attrition media 42.

Rather than removing the attrition media for recycling at that point, as in FIG. 1, in FIG. 2 froth flotation is carried out prior to removing the attrition media.

Following the scrubber 40, the feed 46 is directed to a sizing apparatus 70 wherein waste material 72 scrubbed from the surfaces of the slimes is removed, as the finest fraction, and is discarded as waste, as in the FIG. 1 sizing apparatus 54. However, the attrition media remains.

Scrubbed slimes and attrition media combined then serves as flotation feed 74, directed to a froth flotation stage 76. The flotation stage 76 produces froth 78, which necessarily contains the desired product in this embodiment, as well as tails 80, which settles. As a particular example, in the FIG. 2 embodiment the slimes may contain ground-up particles of quartz and mica. In the flotation stage 76, the mica floats as part of the froth 78, and the quartz and attrition media stay behind as the tails 80.

In FIG. 2, the flotation stage 76 is followed by a sizing apparatus 82 which separates out the relatively coarser attrition media 84 from the remaining tails 86, which in this particular example comprise quartz. As in FIG. 1, in FIG. 2 the attrition media 84 is preferably recycled, to be introduced as the attrition media 42 into the scrubber 40.

FIGS. 1 and 2 described hereinabove depict embodiments of the invention wherein minerals in the form of fine material are recovered from the slime streams in otherwise conventional froth flotation facilities, as part of the overall processing.

Figure 3:
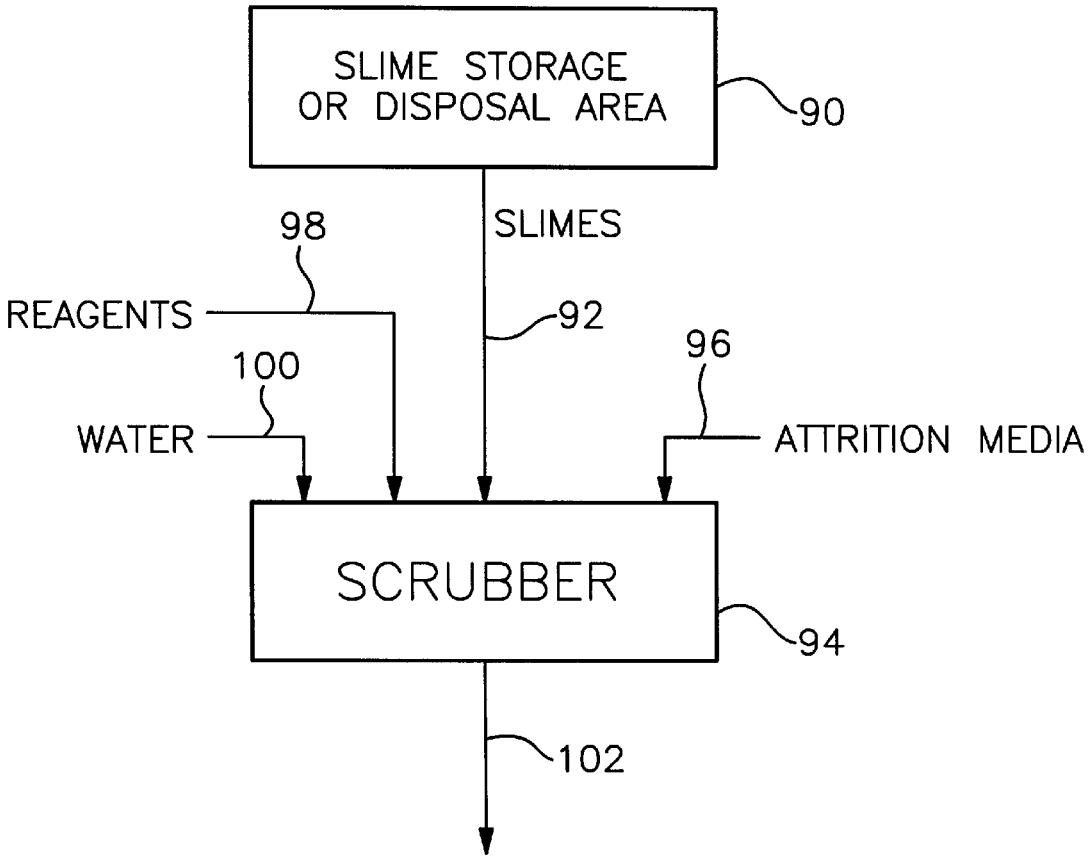
FIG. 3 is a partial schematic flow diagram representing the recovery of slimes from a waste dump.

With reference to FIG. 3, embodiments of the invention are also useful in the recovery of minerals from fine flotation feed (slimes) that have previously been discarded to waste sites, such as pond storage, waste piles or land fill. Accordingly, embodiments of the invention permit the recovery of useful minerals from the waste.

Thus, in FIG. 3, a slime storage or disposal area is represented at 90. Slimes 92, either as a slurry or as powder or clumps, are delivered from the slime storage or disposal area 90 to a scrubber 94, analagous to the scrubber 40 of the embodiments of FIGS. 1 and 2, to which attrition media 96, cleaning reagents 98 and water 100 are added, as described hereinabove. Output 102 from the scrubber of FIG. 3 is then processed in the same manner described hereinabove as the output 46 from the scrubber 40 of FIG. 1, or the output 70 from the scrubber 40 of FIG. 2.

Embodiments of the invention thus process slimes to produce a flotation feed which reacts selectively and efficiently to flotation procedures, either in existing flotation plants, intercepting a feed that would otherwise be discarded to waste, or processing previously-discarded fine flotation feed (slimes).

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A method for recovering minerals from slimes, comprising:

scrubbing the slimes in the presence of attrition media;

removing the attrition media to produce a flotation feed; and subjecting the flotation feed to froth flotation.

2. The method of claim 1, wherein the attrition media comprises a material which does not react chemically with water or with reagents used during scrubbing.

3. The method claim 1, wherein the attrition media has a particle size larger than that of the slimes being scrubbed.

4. The method of claim 1, wherein the attrition media comprises silica sand.

5. The method of claim 1, which comprises scrubbing slimes from a desliming stage in a froth flotation facility.

6. The method of claim 1, which comprises scrubbing slimes supplied from a slime storage or disposal area.

7. A method for recovering minerals from slimes, comprising:

scrubbing the slimes in the presence of attrition media to produce a flotation feed;

subjecting the flotation feed to froth flotation, during which desired product is separated and carried away in froth and other slime particles and attrition media remain behind as tails; and removing attrition media from the tails.

8. The method of claim 7, wherein the attrition media comprises a material which does not react chemically with water or with reagents used during scrubbing and froth flotation.

9. The method of claim 7, wherein the attrition media has a particle size larger than that of the slimes being scrubbed.

10. The method of claim 7, wherein the attrition media comprises silica sand.

11. The method of claim 7, which comprises scrubbing slimes from a desliming stage in a froth flotation facility.

12. The method of claim 7, which comprises scrubbing slimes supplied from a slime storage or disposal area.

* * * * *